United States Patent [19]

Nishimiya

[11] 4,260,153

[45] Apr. 7, 1981

[54] GAME INCORPORATING AN INCLINED RAMP IN A BALL LAUNCHING MECHANISM

[75] Inventor: Toru Nishimiya, Tokyo, Japan

[73] Assignee: Tomy Kogyo Co., Inc., Tokyo, Japan

[21] Appl. No.: 104,790

[22] Filed: Dec. 18, 1979

[30] Foreign Application Priority Data

Dec. 27, 1978 [JP] Japan ..... 53/182403[U]

[51] Int. Cl.[3] ..... A63F 7/06

[52] U.S. Cl. ..... 273/89; 273/DIG. 26

[58] Field of Search ..... 273/89, 90, 124 R, 125 R, 273/121 R, 123 R, 118 D, 121 D, 122 R, DIG. 26

[56] References Cited

U.S. PATENT DOCUMENTS

| | | | |
|---|---|---|---|
| 1,994,685 | 3/1935 | Callejas | 273/89 |
| 2,110,902 | 3/1938 | Bailey | 273/89 |
| 3,358,997 | 12/1967 | Belz | 273/89 |
| 3,834,701 | 9/1974 | Hashimoto | 273/DIG. 26 X |
| 4,179,123 | 12/1979 | Tsukuda | 273/89 |

*Primary Examiner*—George J. Marlo

*Attorney, Agent, or Firm*—K. H. Boswell; Edward D. O'Brian

[57] ABSTRACT

A game of the type having a housing and including in the housing a ball launching mechanism, a propulsion mechanism and at least one target is improved by incorporating in the game a plurality of balls and a reservoir means located to store these balls and feed them one at a time to the ball launching mechanism. The ball launching mechanism includes an inclined ramp positioned to receive the balls from the reservoir. The balls roll down the inclined ramp and are positioned in the proximity of the propulsion mechanism such that if movement of the propulsion mechanism is coordinated with movement of the balls down the inclined ramp the propulsion mechanism is capable of acting on the balls and propelling them toward the target. Associated with the target is a counter mechanism which indicates the number of balls which have been successfully propelled toward the target and captured by the target.

10 Claims, 7 Drawing Figures

GAME INCORPORATING AN INCLINED RAMP IN A BALL LAUNCHING MECHANISM

BACKGROUND OF THE INVENTION

This invention relates to a game which incorporates an inclined ramp as part of a delivery system for a series of balls. Associated with the lower end of the inclined ramp is a propulsion mechanism which, if activated at the correct time, will strike a ball coming down the inclined ramp and propel the same toward the target. A counter mechanism is associated with the target to tell the player how many balls he has successfully deposited in the target.

Many games are known which use the principle of gravity to feed a ball from a launcher to a target. Games such as the one described in U.S. Pat. No. 3,498,615 utilize a large inclined ramp having a series of baffles thereon. A ball traverses these baffles and is deposited in a target area. The target is movable by the operator of the game.

Other patents such as U.S. Pat. No. 3,934,881 allow a ball to descend vertically over a series of platforms placed one under the other which are tiltable. As the ball is successfully transferred to lower and lower platforms means are provided to assign a score totally dependent on the number of platforms successfully traversed.

U.S. Pat. No. 3,834,701 describes a toy basketball game which includes a counter mechanism associated with the basket which counts the number of times a ball is successfully passed through the basket.

U.S. Pat. No. 3,358,997 is directed to a toy baseball game which utilizes a pivotable inclined ramp as a launching means for launching a ball toward a movable bat. After coming down the inclined ramp the ball strikes a small abutment which causes it to lift up and fly through the batting area in a trajectory which places it within the pathway of the movable bat. if the bat successfully strikes the ball, attempts can be made to capture it with a series of upstanding projections which are movable in unison through an ark centered at approximately the pitcher mound area of the game.

All of the above described games contain one detail or another which gives them certain play value. There are, however, certain limitations found in each of these games which, if improved, would further improve the play value of the game.

BRIEF SUMMARY OF THE INVENTION

In view of the above it is considered there exists a need for a new and improved game which incorporates many of the features having very positive play values found in the above noted patents, but which additionally presents these features in new and novel ways rendering the new game extremely interesting and therefore of a very positive play value. It is therefore a broad object of this invention to provide a game which is interesting and fascinating to the user, but which is also variable in operation so that its play value is accessible to a younger child. It is a further object to provide a game which, because of its simplicity of parts, is easily manufactured and thus economical to the consumer and because of its engineering details has a long and useful life.

These and other objects as will become various from the remainder of this specification are achieved in a game of the type having a housing and including a ball launching mechanism, a ball propulsion mechanism and at least one target, the improvement which comprises: a plurality of balls contained within the housing, a reservoir means located in the housing to store said plurality of balls, a ball launching mechanism including an inclined ramp and a ball injection means located near the uppermost periphery of the inclined ramp, said ball injection means operatively associated with said ball reservoir means to receive said ball from said ball reservoir means and inject said ball onto said inclined ramp, said ball propulsion mechanism located near the lower end of said inclined ramp such that as said ball rolls down said inclined ramp said ball can be acted on by said ball propulsion mechanism propelling said ball toward said target.

Operatively associated with the target is a ball counter means which is capable of indicating the number of said balls which have been successfully propelled toward and captured by the target. The ball counter means includes a movable member moving in a ball holding chamber and capable of indicating how many balls are located in the ball holding chamber.

The ball propulsion mechanism includes a propelling member which is movable such that the locus of its movement is in the same area through which the balls must traverse when passing down the inclined ramp. Thus, if the propelling member is activated in coordination with movement of the balls down the inclined ramp the propelling member is capable of striking the balls.

BRIEF DESCRIPTION OF THE DRAWINGS

This invention will be better understood when taken in conjunction with the drawings in which.

Figure 1:
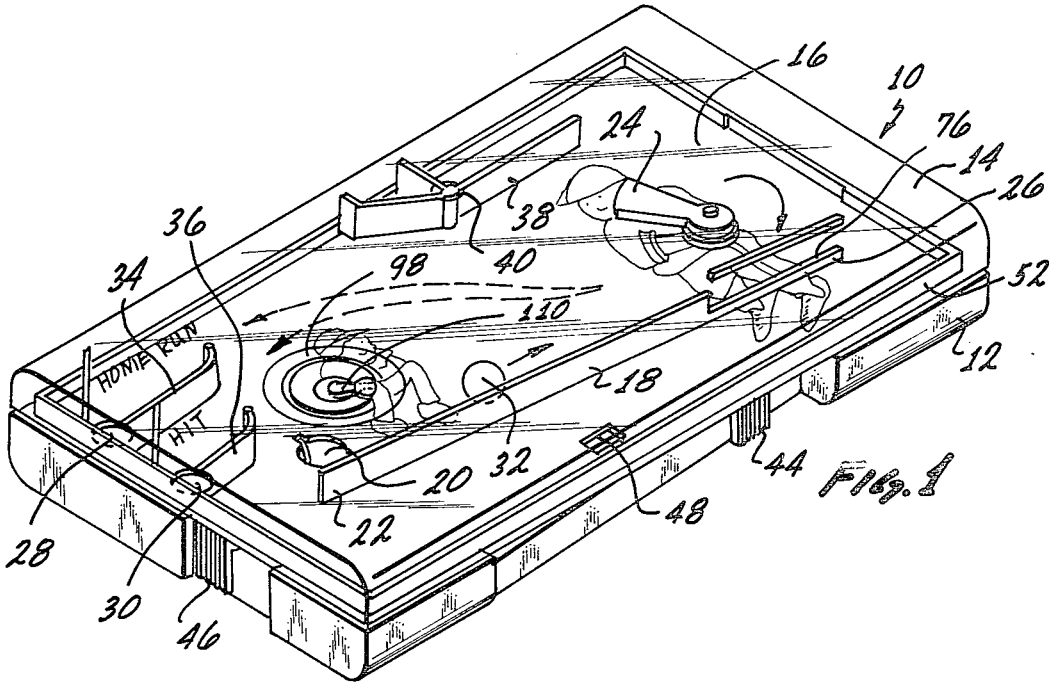
FIG. 1 is an isometric view of the game of the invention.

The invention described in this specification and shown in the drawings utilizes certain principles and/or concepts as are set forth and claimed in the appended claims. Those skilled in the toy arts to which this invention pertains will realize that these principles and/or concepts could be utilized in a number of differently appearing embodiments differing from the exact embodiment described herein. For this reason, this invention is to be construed in light of the appended claims and is not to be construed as being limited to the exact embodiment herein described.

DETAILED DESCRIPTION

The game 10 has a lower housing component 12 and an upper transparent housing component 14. Located within the interior of the game 10 and essentially dividing the game is a surface 16. A plurality of indicia are painted on this surface 16 giving the game a baseball theme.

Integrally formed with upper housing 14 and projecting toward surface 16 is an inclined ramp 18. A ball eject hole 20 is located at the upper end 22 of inclined ramp 18 and a ball batting member 24 is located at the lower end 26 of inclined ramp 18. Two target holes 28 and 30 respectively are located in the upper left-hand corner of the game 10 as seen in FIG. 1. Target hole 28 differs from target hole 30 not only in its position but in its method of accumulating balls collectively identified by the numeral 32 as hereinafter explained. Two shelves 34 and 36 respectively are integrally formed with upper housing 14 and project downwardly toward surface 16 and are located directly beneath target holes 28 and 30 respectively. A baffle 38 integrally formed with upper housing 14 and projecting toward surface 16 serves to feed the balls 32 after completion of play into reservoir feed hole 40.

Figure 2:
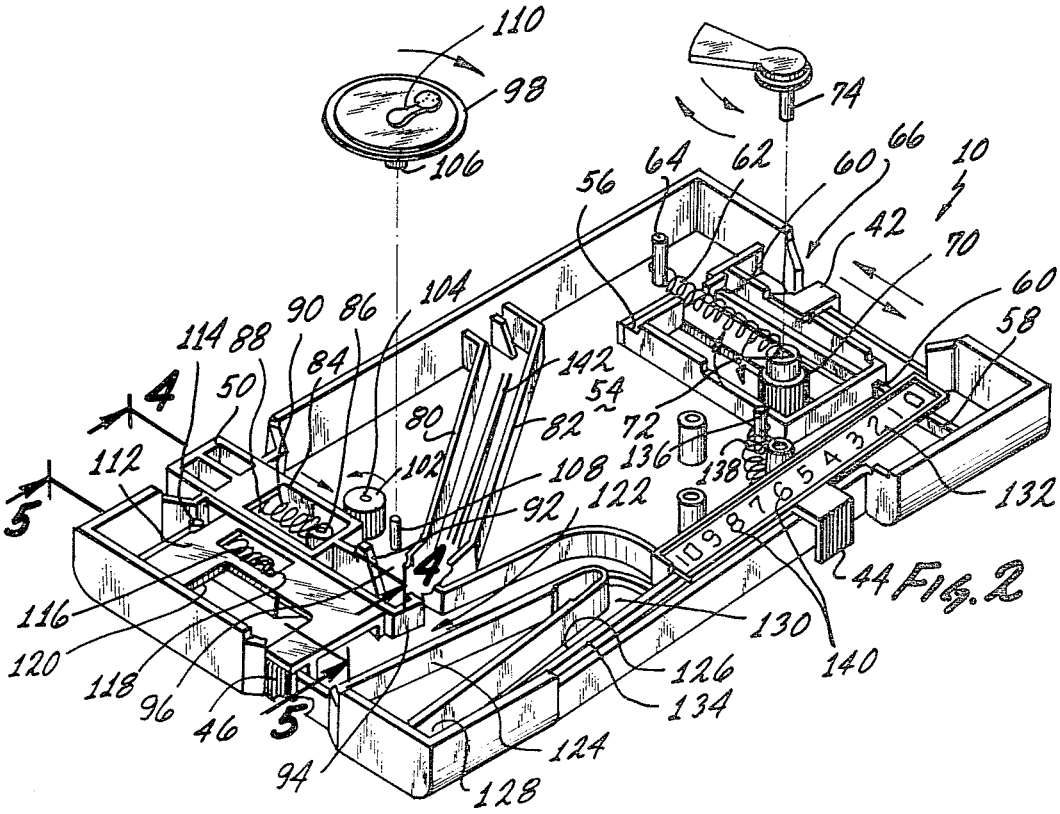
FIG. 2 is an isometric view partially exploded showing the game of FIG. 1 with certain of the overlaying components removed.
Figure 3:
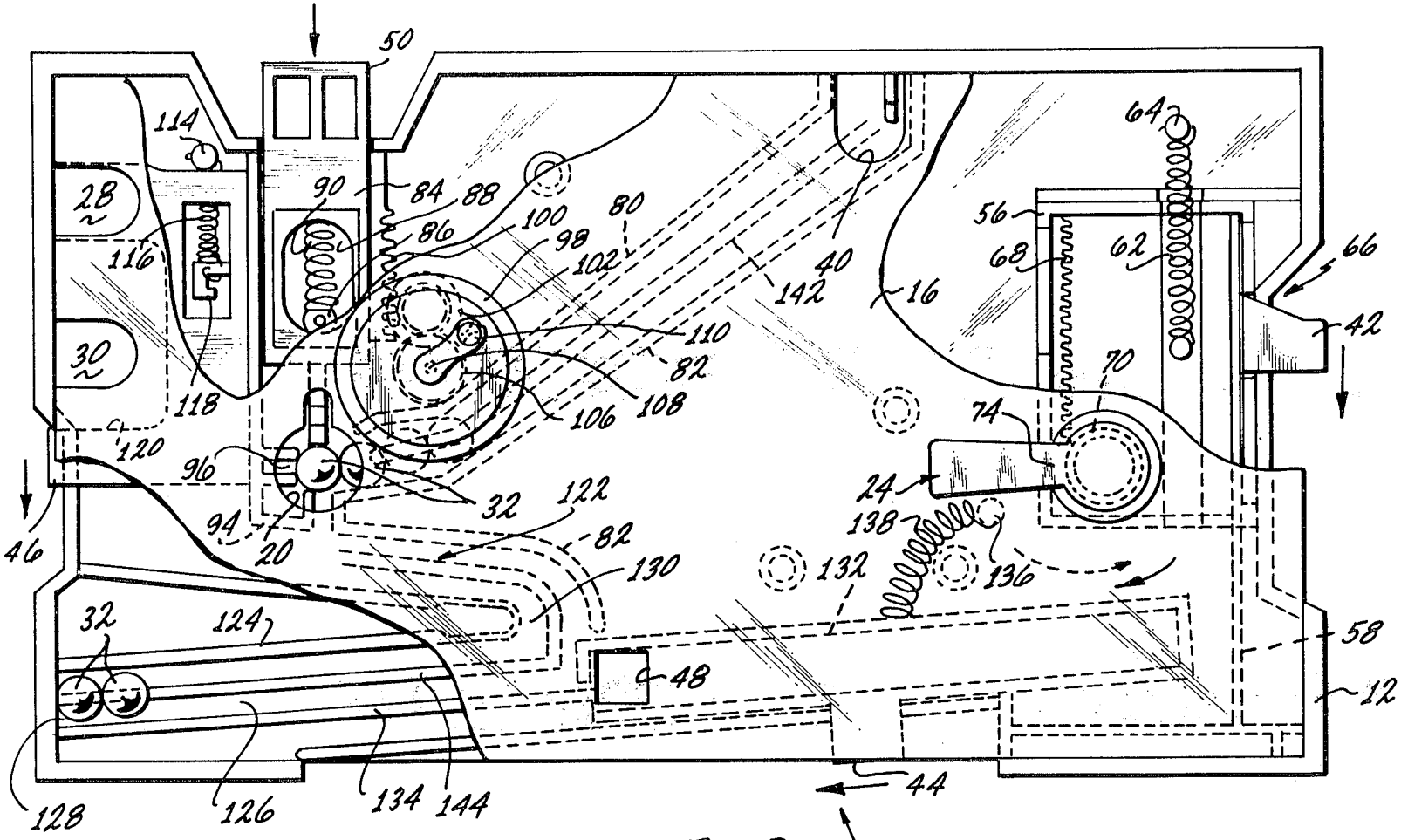
FIG. 3 is a top plan view of the game shown in FIG. 1 in partial section.
Figure 4:
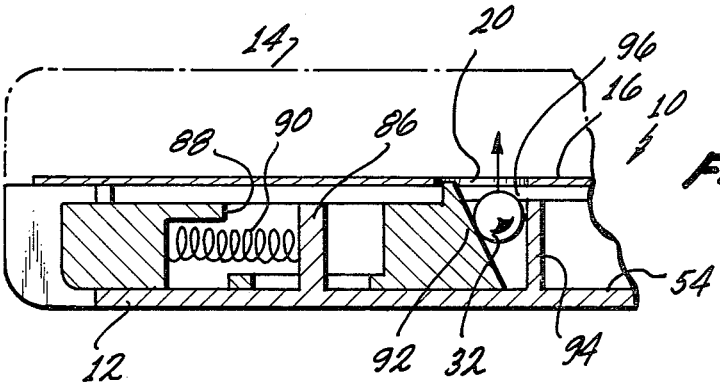
FIG. 4 is an end elevational view about the line 4—4 of FIG. 2.
Figure 5:
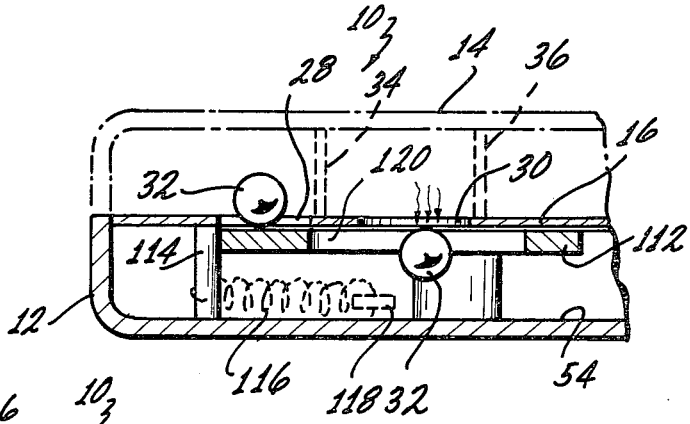
FIG. 5 is an end elevational view about the line 5—5 of FIG. 2.
Figure 6:
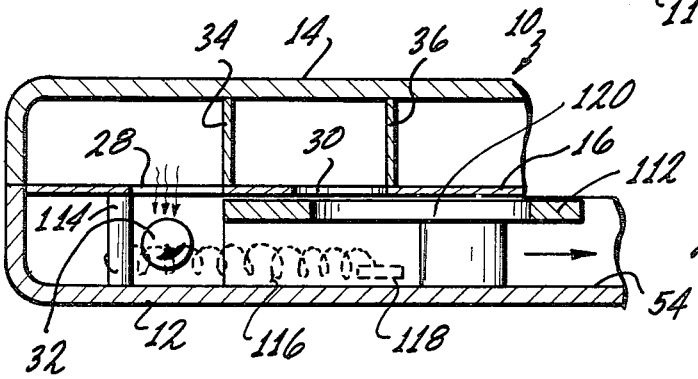
FIG. 6 is an end elevational view identical to FIG. 5 except certain components are shown in a different spatial relationship.

Projecting out of lower housing 12 in the right hand side of FIGS. 1 and 2 is batter button 42. Located on the bottom of lower housing 12 is scoring button 44. Located on the left-hand side of the lower housing 12 is home run button 46. Just above scoring button 44 on surface 16 is scoring indicator hole 48. Located on the upper surface of lower housing 12 is ball ejection button 50.

Before indicating how all of these components are mechanically related and work, a brief summary of how the game is played will help to appreciate the interreaction of the components. The batting member 24 is cocked by depressing the batter button 42 in a downward motion. A ball 32 is then ejected from the ball eject hole 20 by depressing the ball eject button 50. The ball 32 rolls down the inclined ramp 18 and when it is near the lower end 26 of ramp 18 the batter button 42 is released causing the batting member 24 to rotate clockwise, and if the release of the button 42 is coordinated with the position of the ball 32 the batting member 24 will strike the ball 32 and propel it toward the left hand side of the game.

If the batting button 42 is released at the proper time the ball will be given an upward motion along with its sideways motion. If properly struck it will come to rest on either shelf 34 or 36. The ball 32 rolls down the shelves 34 and 36 to be located over the target holes 28 and 30. The ball 32 then passes through the target holes 28 and 30 as hereinafter more fully explained, and comes to rest inside the lower left-hand side of the lower housing 12. After all of a plurality of balls have been either (a) successfully hit so that they are in the area of the target holes or (b) they have been missed or hit but misdirect and have come to rest against the bottom edge 52 of the upper housing 14, the scoring button 44 is slid toward the left. The number of balls that have been deposited through either of the target holes 28 or 30 will be indicated by a numeral viewable in the scoring indicator hole 48. The game 10 is then inverted and shook to locate all of the balls 32 between the upper housing 14 and the surface 16 and then the game is turned right side up again so that the balls can be guided by baffles 38 and deposited in reservoir feed hole 40. At this time play of the game can be started once again.

The batting member 24 is controlled as follows. On the lower surface 54 of lower housing 12 is a slidable cage 56. An upstanding rib 58 projects from the lower surface 54. The cage 56 has two notches collectively identified by the numeral 60 one located on either of its ends which fit over the rib 58 and serve to guide the cage 56 along the length of the rib 58. A spring 62 fitting around an upstanding peg 64 which projects from the lower surface 54 attaches to the cage 56 and biases it toward peg 64. Batting button 42 is integrally formed with cage 56 and projects through the lower housing 12 via opening 66. A rack of gears 68 are formed on cage 56 in a parallel relationship with rib 58. A small axle (not seen nor numbered) projects upwardly from the lower surface 54 and serves as an axle for pinion 70. Pinion 70 engages the rack of gears 68 and is rotated as the cage 56 slides up and down along the surface or rib 58. Pinion 70 has a trapezoid shaped opening 72 in its upper surface which receives batting arm 74 and fixedly locks the movement of batting arm 74 with respect to the position of the batter button 42 via the interaction of the pinion 70 with the rack of gears 68. Arm 74 is located over surface 16 and is thus visible to the player using the game 10.

The lower end 26 of inclined ramp 18 is split such that a channel 76 is formed therein. Arm 74 is positioned with respect to inclined ramp 18 such that when the arm 74 rotates it travels through the channel 76 insuring that the arm 74 will meet with and strike any ball 32 which is located at the lower end 26 of the ramp 18 at the same time the arm 74 moves. In play the player pushes the batting button 42 such that the arm 74 rotates counterclockwise to cock the arm 74 and places spring 62 under tension. When the button 42 is released the tension of spring 62 causes the cage 56 to move and rapidly rotates the arm 74.

A ball reservoir 76 is located beneath surface 16. Two upstanding ribs 80 and 82 which are integrally formed with lower housing 14 and project upwardly toward surface 16 between the reservoir feed hole 40 and the ball eject hole 20 form this reservoir 76. The reservoir 76 is sized to be able to contain all of the balls which are used in playing the game 10.

The ball eject button 50 is integrally formed with the eject member 84. A peg 86 projects upwardly from lower housing 14 and fits within a cutout 88 in the eject member 84. A compression spring 90 fits within the cutout 88 between peg 86 and member 84 and biases eject member 84 such that the button 50 is pushed outwardly from the lower housing 12.

A wedge 92 is formed on the end of eject member 84 and is positioned below ball eject hole 20. A rib 94 which in conjunction with peg 86 serves as a guide for eject member 84 also defines portions of an eject chamber 96. The other portions of this chamber are defined by portions or ribs 80 and 82. A ball 32 located in the reservoir 76 rolls through the reservoir until it is located in eject chamber 96. When eject member 84 is slid against the bias of spring 90 the wedge 92 interacts with the ball 32 and because the movement of the ball 32 is inhibited by portions of ribs 80, 82 and 94 the ball rides up the inclined surface of wedge 92 and is injected out of the ball eject hole 20.

Associated with movement of the ball 32 from the ball eject hole 20 is movement of a disk 98 which simulates movement of a pitcher's arm. Located on one side of eject member 84 is a rack of gears 100. These interact with a pinion 102 which is appropriately rotatably mounted on an upstanding axle 104. On the bottom of disk 98 is a second pinion 106 which fits over an axle 108 projecting upwardly from lower surface 54. The axles 104 and 108 position pinions 106 and 102 such that they intermesh. As eject member 84 slides, pinion 102 is rotated by the rack of gears 100 and it in turn rotates pinion 106 which causes disk 98 to rotate counterclockwise simulating movement of the pitcher arm 110 painted on the surface of disk 98.

Connected to home run button 46 is barrier member 112. A peg 114 projects upwardly from surface 54 of lower housing 12 and serves as a holding point for spring 116. A finger 18 formed as part of barrier member 112 is connected to the other end of spring 116. Spring 116 biases barrier member 112. and home run button 46 toward peg 114 such that the surface of barrier member 112 covers target hole 28. A cutout 120 in barrier member 112 is located below target hole 30. Any ball 32 located on shelf 36 will descend through target hole 30 through the cutout 120 and underneath barrier member 112. However, any ball 32 located on shelf 34 will be inhibited from passing through target hole 28 by the surface of barrier member 112. When the home run button 46 is depressed against the bias of spring 116 the surface of barrier member 112 moves away from target hole 28 allowing any balls 32 located on shelf 34 to freely pass through target hole 28 underneath barrier member 112.

A feed channel 122 composed in part by rib 124 and in part by rib 82 leads from underneath barrier member 112 to holding chamber 126. Any ball 32 which passes through either of the target holes 28 or 30 is conducted down channel 122 into the holding chamber 126. One end 128 of holding chamber 126 is fixed. The other end 130 of holding chamber 126 is open. The holding chamber 126 is defined by part of rib 124 and by part of a rib 134.

Figure 7:
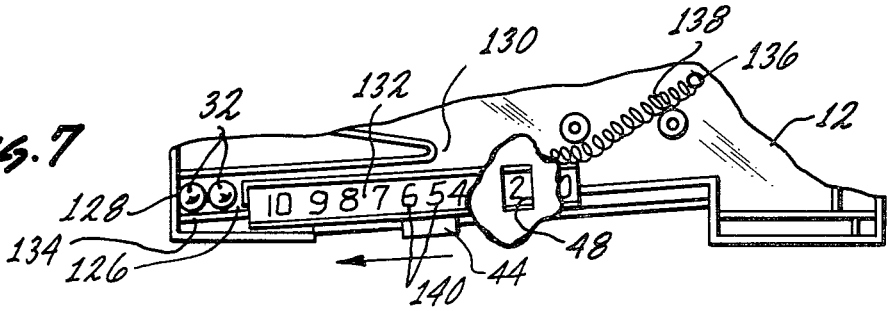
FIG. 7 is a partial plan view of that portion of the game shown in the lowermost center section of FIG. 2, differing however from FIG. 2 in that certain components are shown in a different spatial relationship.

Movable member 132 has cutouts (not seen or numbered in the figures) which allow it to slide along rib 134 into the holding chamber 126. Integrally formed with the movable member 132 is scoring button 44. A peg 136 projects upwardly from lower surface 54 of lower housing 12. A spring 138 attaches to this peg and attaches to the underside (not seen) of movable member 132. This biases movable member 132 away from holding chamber 126. When movable member 132 is slid via scoring button 44 into the holding chamber 126, depending on the number of balls 32 located in holding chamber 126, movable member 132 will be allowed to only occupy that area of holding area 126 not occupied by any of the balls 32. A plurality of numerical indicia 140 on the surface of movable member 132 are viewable one at a time through scoring indicator hole 48. The particular member of the indicia 140 which will be exposed through scoring indicator hole 48 depends on how far movable member 132 can slide into holding chamber 126. The indicia on movable member 132 are numbered from right to left. Normally 10 balls 32 would be used in the game 10; thus, the indicia are numbered from zero to 10. If only one ball is located in holding chamber 126 the movable member 132 will be capable of moving to the left into holding chamber 126 a distance equal to nine balls, thus exposing the number "1" through the scoring indicator hole 48. If two balls are located in the holding chamber 126 as is shown in FIG. 7, the movable member 132 will only be allowed to move to the left a distance equal to the diameter of two balls, thus exposing the number "2" and so on for the remaining number of balls 32. In this way, the numeral exposed through the scoring indicator hole 48 exactly equals the number of balls located in the holding chamber 126.

In order to assist the balls 32 in rolling through the channels 76, 122 and the holding chamber 126 a sloping rib 142 is placed in the bottom of channel 76 and, likewise, a sloping rib 144 is placed through channel 122 and holding chamber 126.

The game 10 may be held during play such that the surface 16 is inclined slightly to the horizontal for easy play and this surface 16 is made more and more vertical for more expert play. When the surface 16 is completely vertical the balls 32 roll down the inclined ramp 18 at a faster rate than when the surface 16 is less than vertical. This allows the game 10 to be used by a variety of players differing somewhat in their coordination skills.

I claim:

1. A game of the type having a housing and including a ball launching mechanism, a ball propulsion mechanism and at least one target located in the housing which comprises:

a plurality of balls contained in said housing:

a reservoir means located in said housing to store said plurality of balls;

said ball launching mechanism including an inclined ramp, a ball injection means located near the uppermost end of said inclined ramp, said ball injection means operatively associated with said ball reservoir means to receive said ball from said ball reservoir means and inject said balls onto said inclined ramp one at a time;

said ball propulsion mechanism located near the lower end of said inclined ramp such that as said balls roll down said inclined ramp said balls can be acted on by said ball propulsion mechanism propelling said balls toward said target.

2. The game of claim 1 including:

a ball counter means operatively associated with said target and capable of indicating the number of said balls which having been propelled toward said target have been successfully captured by said target.

3. The game of claim 2 wherein:

said ball counter means includes a ball holding chamber sized to contain all of said plurality of balls, means connecting said target and said holding chamber to transfer said balls successfully deposited in said target into said holding chamber, a movable member capable of moving into said holding chamber and occupying that portion of said holding chamber which is not occupied by said balls transferred to said chamber from said target;

indicating means indicating that portion of space of said holding chamber occupied by said movable member.

4. The game of claim 3 wherein:

said holding chamber includes a closed end and an opened end, said means connecting said target and said holding chamber conveying balls from said target to said opened end;

said movable member capable of moving into said holding chamber through said opened end toward said closed end;

said indicating means includes a plurality of indicia spaced along said movable member and said housing having an opening allowing viewing of one of said indicia at a time;

said movable member sliding through said opened end of said holding chamber until said moving member abuts against the last of said balls to be deposited in said holding chamber to locate said balls in said holding chamber between said closed end of said holding chamber and said moving member and position one of said indicia below said opening.

5. The game of claim 2 wherein:

said ball propulsion mechanism includes a propelling member capable of moving through the plane of said inclined ramp and contacting a ball moving in the plane of said inclined ramp such that the direction of motion of said ball down said inclined ramp is essentially reversed.

6. The game of claim 3 wherein:

said holding chamber includes a closed end and an opened end, said means connecting said target and said holding chamber conveying balls from said target to said opened end;

said movable member capable of moving into said holding chamber through said opened end toward said closed end;

said indicating means includes a plurality of indicia spaced along said movable member and said surface having an opening allowing viewing of one of said indicia at a time;

said movable member sliding through said opened end of said holding chamber until said moving member abuts against the last of said balls to be deposited in said holding chamber to locate said balls in said holding chamber between said closed end of said holding chamber and said moving member and position one of said indicia below said opening.

7. The game of claim 1 wherein:

said ball propulsion mechanism includes a propelling member capable of moving through the plane of said inclined ramp and contacting a ball moving in the plane of said inclined ramp such that the direction of motion of said ball down said inclined ramp is essentially reversed.

8. The game of claim 7 wherein:

said housing includes a surface;

said inclined ramp projects essentially perpendicular to said surface;

said propelling member being rotatably mounted on said surface in association with the lower end of said inclined ramp such that each of said plurality of said balls travelling down said inclined ramp passes through the locus of travel of said propelling member and said propelling member is capable of contacting each of said plurality of said balls if the rotary movement of said propelling member is coordinated with the travel of said ball down said inclined ramp.

9. A game of the type having a housing and including a ball launching mechanism, a ball propulsion mechanism and at least one target located in the housing which comprises:

a plurality of balls contained in said housing;

a reservoir means located in said housing to store said plurality of balls;

said ball launching mechanism including an inclined ramp, a ball injection means located near the uppermost end of said inclined ramp, said ball injection means operatively associated with said ball reservoir means to receive said ball from said ball reservoir means and inject said balls onto said inclined ramp one at a time;

said ball propulsion mechanism located near the lower end of said inclined ramp such that as said balls roll down said inclined ramp said balls can be acted on by said ball propulsion mechanism propelling said balls toward said target, a ball counter means operatively associated with said target and capable of indicating the number of said balls which having been propelled toward said target have been successfully captured by said target, said ball propulsion mechanism includes a propelling member capable of moving through the plane of said inclined ramp and contacting a ball moving in the plane of said inclined ramp such that the direction of motion of said ball down said inclined ramp is essentially reversed.

10. The game of claim 9 wherein:

said ball counter means includes a ball holding chamber sized to contain all of said plurality of balls, means connecting said target and said holding chamber to transfer said balls successfully deposited in said target into said holding chamber, a movable member capable of moving into said holding chamber and occupying that portion of said holding chamber which is not occupied by said balls transferred to said chamber from said target;

indicating means indicating that portion of space of said holding chamber occupied by said movable member, said holding chamber includes a closed end and an opened end, said means connecting said target and said holding chamber conveying balls from said target to said opening end;

said movable member capable of moving into said holding chamber through said opened end toward said closed end;

said indicating means includes a plurality of indicia spaced along said movable member and said housing having an opening allowing viewing of one of said indicia at a time;

said movable member sliding through said opened end of said holding chamber until said moving member abuts against the last of said balls to be deposited in said holding chamber to locate said balls in said holding chamber between said closed end of said holding chamber and said moving member and position one of said indicia below said opening;

said housing includes a surface;

said inclined ramp projects essentially perpendicular to said surface;

said propelling member being rotatably mounted on said surface in association with the lower end of said inclined ramp such that each of said plurality of said balls travelling down said inclined ramp passes through the locus of travel of said propelling member and said propelling member is capable of contacting each of said plurality of said balls if the rotary movement of said propelling member is coordinated with the travel of said ball down said inclined ramp.

* * * * *